United States Patent [19]

Brucato

[11] 4,347,100

[45] Aug. 31, 1982

[54] STRENGTH OF PAPER FROM MECHANICAL OR THERMOMECHANICAL PULP

[75] Inventor: Albert Brucato, Seattle, Wash.

[73] Assignee: The Chemithon Corporation, Seattle, Wash.

[21] Appl. No.: 265,811

[22] Filed: May 21, 1981

[51] Int. Cl.[3] ..... D21B 1/16

[52] U.S. Cl. ..... 162/10; 162/11; 162/24; 162/26; 162/28; 162/71; 162/72; 162/76; 162/158; 162/164.3; 162/164.6; 162/166; 162/168.3; 162/175

[58] Field of Search ..... 162/11, 24, 76, 26, 162/71, 72, 28, 13, 175, 10, 166, 164 R, 164 EP, 168 NA, 168 R, 168 N, 158, 108.3, 164.3, 164.6

[56] References Cited

U.S. PATENT DOCUMENTS

| | | | |
|---|---|---|---|
| 1,983,008 | 12/1934 | Snyder . | |
| 1,991,335 | 2/1935 | Reddish . | |
| 2,072,487 | 3/1937 | Snyder . | |
| 2,197,463 | 4/1940 | Bradner . | |
| 2,668,110 | 2/1954 | Spencer . | |
| 3,597,310 | 8/1971 | Sumi et al. | 162/25 |
| 3,773,610 | 11/1973 | Shouvlin et al. | 162/19 |
| 3,819,470 | 6/1974 | Shaw et al. . | |
| 3,839,215 | 10/1974 | Mulders | 210/735 |
| 4,062,721 | 12/1977 | Guyer et al. . | |
| 4,145,246 | 3/1979 | Goheen et al. | 162/23 |
| 4,152,199 | 5/1979 | Hamerstrand et al. | 162/175 |

FOREIGN PATENT DOCUMENTS

| | | | |
|---|---|---|---|
| 35854 | 6/1886 | Fed. Rep. of Germany | 162/24 |
| 93685 | 4/1959 | Norway | 162/26 |
| 1266898 | 3/1972 | United Kingdom | 162/28 |

OTHER PUBLICATIONS

Schwartz et al., "Surface Active Agents & Detergents", vol. II, pp. 155–159 (1958).

*Primary Examiner*—William F. Smith

*Attorney, Agent, or Firm*—Merriam, Marshall & Bicknell

[57] ABSTRACT

An additive comprising an anionic organic surface active agent is incorporated into mechanical or thermomechanical pulp at an elevated temperature and pressure. The additive causes dispersion of lignin and retards redeposition of lignin so that the bursting strength of the paper formed from the pulp is improved. The preferred additives are higher molecular weight anionic organic polyelectrolytes or polymers, particularly polymeric sulfonates. Further improvement in bursting strength is achieved by the wet end addition of a cationic organic polyelectrolyte or polymer, with or without starch. Lower molecular weight anionic organic detergents can also be used but should be rinsed from the pulp before forming paper.

24 Claims, No Drawings

STRENGTH OF PAPER FROM MECHANICAL OR THERMOMECHANICAL PULP

This invention relates to the improvement of the strength of paper made from mechanical or thermomechanical pulp.

BACKGROUND OF THE INVENTION

Reduction of wood to a fibrous state by mechanical attrition for the production of mechanical pulp has long been recognized as advantageous because of the high pulp yields approaching 100% as compared with chemical pulping methods in which the wood is cooked in a chemical reagent which reacts with or dissolves lignin to effect fiber separation.

The fibers in wood are bonded together by lignin and must be separated from one another to be useful in papermaking. As noted, chemical methods can do this by largely dissolving the lignin so as to free the fibers. However, mechanical methods do this by physically forcing the fibers apart so that the lignin is not removed for the most part. The oldest method of making mechanical pulp is by grinding wet logs, and such pulp is referred to as groundwood pulp. A more modern mechanical pulping method utilizes a disc refiner in which wet wood chips are mechanically defibered by rotating discs, and the resultant pulp is referred to as refiner mechanical pulp (RMP).

In the disc refiner, the lignin is somewhat softened by the frictional heat generated in the mechanical defibering process which facilitates fiber separation. The lignin is not softened enough to flow, however, and the fibers are not easily pulled out of their lignin ensheathment. This results in the fracture of some of the fibers in addition to the continued adhesion of some of the lignin to some of the fibers. The inherent strength of paper is due principally to hydrogen bonding between cellulose fibers, but lignin does not bond effectively to itself. Consequently, the strength of the paper formed from refiner mechanical pulp is generally inferior to that of paper produced from chemical pulp.

In recent years so-called thermomechanical pulp (TMP) has gained wide acceptance in the industry. In the thermomechanical pulping process wood chips are preheated with steam at an elevated temperature and pressure and are then defibered in a disc refiner also at an elevated temperature and pressure. As a result of the increased temperature due to the preheating step, the lignin is softened to a greater extent than in conventional mechanical pulping processes. Consequently, the cellulosic fibers are pulled apart and separated more easily to obtain comparatively intact whole fibers with substantially less fragmentation of the fibers. It would be expected that the whole fibers in thermomechanical pulp would result in stronger paper than can be obtained from groundwood pulp or from refiner mechanical pulp, but such improved strength has not been realized in most cases. Although lignin may become detached from the fibers to some extent during the mechanical defibering step, in general the heat softened lignin tends to redeposit on the fibers and harden in place as the pulp cools so that the fibers are lignin coated. This lignin coating of the fibers results in poor fiber-to-fiber bonding during subsequent paper manufacture.

Thus, even though thermomechanical pulp is attractive because of the high pulp yields and the diminished fiber fragmentation inherent in the thermomechanical pulping process, nevertheless, for many purposes the strength of the paper made from thermomechanical pulp is inadequate. In current practice, it is frequently necessary to upgrade thermomechanical pulp by blending with it a substantial amount, e.g. 10–25%, of a conventional chemical pulp such as kraft pulp in order to obtain the required strength in the paper, thereby increasing the overall cost of producing an acceptable paper.

SUMMARY OF THE INVENTION

Broadly speaking, in accordance with the present invention a relatively small amount of an additive comprising an anionic organic surface active agent is incorporated into mechanical or thermomechanical pulp at an elevated temperature and pressure and is effective to cause dispersion of the lignin and to retard redeposition or coating of the lignin on the fibers during defibering of the wood and during subsequent cooling of the pulp. As a result, the paper that is formed from such pulp has substantially improved strength characteristics so that in most cases it is unnecessary to upgrade the pulp by addition of chemical pulp or by other means.

In certain cases a further improvement in the strength of the paper may be achieved, in accordance with the present invention, by incorporating in the furnish prior to the formation of paper, a relatively small amount of a cationic organic additive that is capable of reacting with the aforementioned anionic organic additive in the pulp. This step also results in an improvement in yield since the cationic additive also acts as as a retention agent and reduces the loss of fines. Even further strength improvement may be obtained, in accordance with the present invention, by adding starch to the pulp along with the aforementioned cationic additive. The temperature is maintained below the gelatinization temperature of the starch so that gelatinization does not occur until the heat drying stage in the papermaking machine.

Accordingly, the primary object of the present invention is to provide an improved mechanical or thermomechanical pulp that results in increased strength characteristics in the paper made from such pulp.

A further object of the invention is to enhance fiber-to-fiber bonding in the manufacture of paper from mechanical or thermomechanical pulp so as to improve the strength characteristics of the paper made from such pulp.

Another object of the invention is to prevent or retard lignin coating of the wood fibers produced by mechanical or thermomechanical pulping methods.

An additional object of the invention is to provide an improvement in the strength of paper made from mechanical or thermomechanical pulp by incorporating into the pulp an anionic organic surface active agent at an elevated temperature and pressure; further strength improvement is achieved by also incorporating a cationic organic additive in the resultant pulp, with or without simultaneous addition of starch.

Other objects and advantages of the invention will be understood from the subsequent detailed description.

DETAILED DESCRIPTION

As heretofore described, in the production of mechanical or thermomechanical pulp the wood fibers are separated in the defibering stage but tend to remain ensheathed in lignin or to become coated with softened lignin which then hardens when the pulp cools. The lignin coating on the pulp fibers results in poor fiber-to-fiber bonding and diminished strength in the ultimate paper. Moreover, the lignin coating on the fibers may interfere with the desired fibrillation of the separated fibers during subsequent beating of refining of the pulp in the preparation of the furnish for the papermaking machine, thereby increasing the energy consumption in the beating step and causing a reduction in fiber length which also contributes to loss of strength in the paper.

It has been discovered that by incorporating into mechanical or thermomechanical pulp under appropriate conditions a small amount of an anionic water soluble surface active agent comprising either a relatively higher molecular weight anionic organic polyelectrolyte or polymer or a relatively lower molecular weight anionic organic detergent, a significant improvement is obtained in the strength of the paper made from such pulp. The anionic surface active agent must be incorporated into the pulp by "cooking in" the additive at an elevated temperature and pressure with agitation or mixing in order to achieve the desired strength improvement. In some cases this can be accomplished by adding the anionic surface active agent before or during the refining or defibering stage, and in other cases it will be necessary to subject the pulp and the anionic surface active agent to a post-refining cook.

For example, in the thermomechanical pulping process as used for producing papermaking fiber, wood chips are supplied to a preheater in which the chips are preheated with steam at a temperature of from about 100° to about 145° C. and a pressure of from about 5 to about 45 psig. The preheated chips are then introduced into a disc refiner where defibering of the chips by mechanical attrition is carried out at a similar elevated temperature and pressure. In such thermomechanical pulping, the anionic surface active agent may conveniently be added to the preheater or to the disc refiner or to both. In any case, the elevated temperature and pressure conditions and the agitation or mixing in the disc refiner are effective to "cook in" the additive during formation of the pulp so as to achieve the desired end result.

In the case of refiner mechanical pulp, no external heat is added in the refining stage to supplement the frictional heat generated in the disc refiner. For purposes of the present invention, therefore, it is necessary to utilize an additional post-refining step in which the pre-formed pulp is cooked with the anionic surface active agent at an elevated temperature and pressure and with suitable agitation or mixing in order to obtain the desired strength improvement in the subsequently formed paper. In such case, the anionic surface active agent may be added either to the refiner or to the post-refining cook or to both. The previously formed RMP slurry with the added anionic surface active agent may be cooked, for example, in a suitable pressure vessel for a short period, e.g. from about 1 to about 10 minutes, at a temperature of from about 100° to about 145° C. and a pressure of from about 5 to about 45 psig. Vigorous circulation or agitation of the pulp during the cook is desirable for best results. Upon completion of the cook, the pulp is removed from the cooking vessel, cooled to ambient temperature, and then processed in the usual manner to prepare the furnish for the papermaking step.

In the case of thermomechanical pulping, if desired for any reason, the anionic surface active agent may be introduced in a post-refining cook following defibering in the disc refiner. However, there will ordinarily be no advantage in providing this extra step because the addition of the anionic surface active agent prior to or at the disc refiner, which is operated at an elevated temperature and pressure, will accomplish the desired result.

Presumably, the addition of an anionic surface active agent, as described above, results in an improvement in the strength of the ultimate paper because the surface active agent functions as a dispersing agent for the lignin and effectively retains the lignin in dispersed condition. As a result, redeposition of lignin on the fibers during cooling of the pulp is retarded or minimized, and fiber-to-fiber bonding is improved so that a significant increase in paper strength is realized. For example, with the use of various types of polymeric sulfonates as the anionic additive an increase of from about 16 to about 21% in the bursting strength of the paper, as measured by the TAPPI test T 403, may be obtained.

The amount of the surface active agent required to obtain a significant strength improvement in the paper is quite small, e.g. on the order of from about 0.4 to about 0.7 wt.% of the wood chips (o.d. basis) supplied to the defibering step. Although larger amounts of surface active agent may be used, there is usually no significant benefit to be gained.

The preferred anionic organic surface active agents for use in the present invention are anionic organic polyelectrolytes or polymers having a relatively high molecular weight, e.g. in excess of 3000 and most often in excess of 10,000. The polymeric sulfonates are particularly useful, and such compounds are commercially available as the water soluble salts of the corresponding sulfonic acids, e.g. sodium or other alkali metal salts of ammonium salts. Specific examples of suitable polymeric sulfonates are polystyrene sulfonates (e.g. VERSA-TL 4 sodium polystyrene sulfonate by Proctor Chemical Co., Inc.), lignosulfonates (e.g. ORZAN A ammonium lignosulfonate by Crown Zellerbach Corp.) and naphthalene sulfonate condensates (e.g. LOMAR LS naphthalene sulfonate-formaldehyde condensate by Diamond Shamrock Corp.). Other examples of suitable anionic organic polyelectrolytes or polymers are the polymeric carboxylates such as the water soluble salts of acrylic acid polymers and copolymers (e.g. the ACRYSOL materials of Rohm & Haas, the GOODRITE materials of B. F. Goodrich, and the ACCOSTRENGTH materials of American Cyanamid) and maleic acid polymers and copolymers (e.g. GANTREZ AN by GAF Corp.).

In addition, it will be understood by those skilled in the art that equivalent results may be obtained in some cases by using the monomer of the selected anionic organic polyelectrolyte or polymer. Since the monomer is the precursor or reactive species from which the anionic polymer is formed, the elevated temperature and pressure conditions during thermomechanical pulping or during a post-refining cook will induce polymerization of the monomer to form the desired polymer in situ.

Relatively low molecular weight (about 300 to 500) anionic surface active agents of the detergent category may also be used in the present invention, e.g. organic sulfonates, sulfates, ethoxylated sulfates, phosphates, and ethoxylated phosphates. Specific examples of suitable anionic organic detergents are sodium salts of alpha olefin sulfonates of 10 to 20 carbon atoms per molecule, sodium cellulose sulfate, and ammonium salt of ethoxylated lauryl sulfate. While a significant strength improvement in the paper can be obtained by the use of such materials, it has been found to be desirable to rinse the resultant pulp with water in one or more rinsing steps in order to remove the anionic organic detergent before supplying the pulp to the papermaking step. Rinsing of the pulp avoids difficulty in handling the furnish due to the foaming tendencies of these additives and also permits the desired strength improvement to be obtained. Such rinsing, however, is not required when the anionic additive comprises an organic polyelectrolyte or polymer, as described above.

When the anionic additive comprises a relatively higher molecular weight anionic organic polyelectrolyte or polymer, it has been found that a further improvement in paper strength may be obtained by the wet end addition of a cationic organic polyelectrolyte or polymer to the pulp having incorporated therein the aforementioned anionic organic polyelectrolyte or polymer. The cationic additive reacts with the anionic material to form a polysalt in the form of a gum-like precipitate which when dried has good adhesive properties and contributes significantly to the strength of the paper. Suitable cationic additives for this purpose include polyamide-polyamine resins (e.g. KYMENE 557H by Hercules, Incorporated), polyethylene imines (e.g. CHEMICAT P-145 by Chemirad Corporation), urea-formaldehyde resins (e.g. PAREX 615 by American Cyanamid Co.), melamine-formaldehyde resins (e.g. PAREX 607 by American Cyanamid Co.), and polyacrylamides (e.g. SEPARAN CP7 by Dow Chemical Co.).

These cationic materials may be added to the furnish or at the wet end of the papermaking machine in small amounts sufficient to react with the amounts of anionic additive in the pulp or furnish. The required stoichiometric amount of cationic additive may be determined by conventional titration procedures. For example, a constant increment titration of a dilute solution (0.1%) of one additive is made against the other, and the specific conductance is measured after each increment. The specific conductance due to the additive that is added by this titration is calculated as the specific conductance obtained after each increment minus the initial specific conductance of the solution into which the increments are added. From this, the equivalent conductance is plotted against the square root of the concentration of the titrant. A discontinuity in the curve can be taken as a probable stoichiometric point that can then be optimized by trial. In another method, which relies on the formation of a precipitate, the constant increment titration is used to the point that precipitate from previously added increments prevents detection of more precipitate. Then it may be centrifuged to permit continued detection until a next increment forms no precipitate as an endpoint.

By the combined use of anionic and cationic additives in the manner described, an increase in the strength of the paper of from about 20 to about 24% may be realized. The addition of the cationic organic polyelectrolyte or polymer not only enhances the improvement of strength in the paper but also substantially improves the retention of fines.

For optimum improvement in the strength of the paper, starch may also be added along with the organic cationic polymer to the furnish or at the wet end of the papermaking machine. Preferably, the two materials are added together as a premixture in the form of an aqueous solution or suspension, but it is important to maintain the solution at substantially ambient temperature in order to avoid gelatinization of the starch at this point. The combined additive is stirred or agitated into the pulp or furnish, and the reaction of the cationic organic polyelectrolyte or polymer with the anionic organic polyelectrolyte or polymer to produce the gum-like precipitate carries the starch particles along and retains the starch in the wood fibers. The furnish is then supplied to the papermaking machine where it is formed into a sheet and heat dried in the usual manner. During heat drying, the starch is gelatinized in situ in the sheet and thereby contributes substantially to the strength of the paper. Ordinary corn starch (e.g. PEARL industrial unconverted corn starch by Corn Products Corporation, CPC International, Inc.) will be most convenient, but other starches such as potato, tapioca or wheat starch can also be used. The amount of starch used may be from about 5 to about 20 wt.% of the weight of the paper sheet. With the combined use of the anionic additive, the cationic additive, and starch in this manner, an improvement in the strength of the paper of from about 35 to about 53% can be obtained.

For purposes of further illustrating the invention, but not by way of limitation, the following specific examples are presented.

EXAMPLES

A series of laboratory tests were conducted using preformed thermomechanical pulp obtained from a mixture of 70% hemlock and 30% white fir. To simulate the pulping process, a heat insulated pressure vessel was used which had an attached heat exchanger and a pump to circulate the contents of the vessel through the heat exchanger. Heat was supplied by steam fed to the heat exchanger, and the action of the recirculating pump provided the desired agitation and mixing.

In each test, the vessel was charged with a batch of 16 liters of a slurry containing 368 grams of TMP (dry basis) and having a 2.3% consistency, and an anionic additive was added at 0.1 wt.% of the total batch. The cook was carried out for 10 minutes at about 35 psig, a temperature of about 120° to 130° C., and a pH of about 5. Upon completion of the cook, the contents were brought to ambient conditions, removed from the vessel, and filtered.

In accordance with the experimental plan, as indicated below, the pulp was either rinsed to remove the additive or left unrinsed and was then formed into handsheets of paper at a basis weight of approximately 127 g/m$^2$. When rinsing was used, the pulp was subjected to five rinse cycles each consisting of filtering the pulp on a fine mesh screen and recycling the filtrate until free of fines, discarding the filtrate, and reslurrying the pulp in water. In some tests a cationic additive, alone or in admixture with starch, was added to the furnish prior to sheet formation. When starch was used it was added in dry form to an aqueous solution of the cationic additive to form a suspension which was kept at ambient temperature. In each case the handsheets were tested for bursting strength using a Mullen Tester (Model C) according to TAPPI method T 403, and the results were reported as Burst Factor. A cooked control batch with no additives was used as a basis for determining improvement in bursting strength.

The test data are given in the following table:

| Example No. | Additive To Cook | Pulp Rinsed After Cook | Wet End Additive | Burst Factor | % BF Above Control |
|---|---|---|---|---|---|
| 1. | None - Control | Control | None - Control | 10.3 | Control |
| 2. a. | Detergent, AOS-C1416 | No | None | 6.8 | −33 |
| b. | Detergent, AOS-C1416 | Yes | None | 10.7 | 4 |
| c. | Detergent, ELS | No | None | 10.2 | −1 |
| d. | Detergent, ELS | Yes | None | 11.9 | 16 |
| e. | Detergent, AOS-C10 | Yes | None | 11.5 | 12 |
| f. | Detergent, AOS-C18 | Yes | None | 11.4 | 11 |
| g. | Detergent, AOS-C20 | Yes | None | 11.4 | 11 |
| 3. | Detergent, Neodol 25-9 | Yes | None | 7.3 | −29 |
| 4. a. | Versa-TL 4 | No | None | 11.9 | 16 |
| b. | Orzan A | No | None | 12.2 | 18 |
| c. | Lomar LS | No | None | 12.5 | 21 |
| 5. a. | Versa-TL 4 | No | Chemicat P-145 | 12.8 | 24 |
| b. | Versa-TL 4 | No | Kymene 557H | 12.7 | 23 |
| c. | Orzan A | No | Chemicat P-145 | 12.4 | 20 |
| d. | Orzan A | No | Kymene 557H | 12.7 | 23 |
| 6. a. | Versa-TL 4 | No | Premix of Chemicat P-145 and Pearl Corn Starch | 13.9 | 35 |
| b. | Versa-TL 4 | No | Premix of Kymene 557H and Pearl Corn Starch | 15.8 | 53 |
| c. | Orzan A | No | Premix of Chemicat P-145 and Pearl Corn Starch | 14.1 | 37 |
| d. | Orzan A | No | Premix of Kymene 557H and Pearl Corn Starch | 14.5 | 41 |
| e. | Lomar LS | No | Premix of Chemicat P-145 and Pearl Corn Starch | 15.6 | 51 |
| f. | Lomar LS | No | Premix of Kymene 557H and Pearl Corn Starch | 14.2 | 38 |
| 7. a. | None | No | AOS-C1416 (Not rinsed out of pulp before making handsheets) | 3.4 | −67 |
| b. | None | No | AOS-C1416 (Rinsed from pulp before making handsheets) | 5.8 | −44 |
| 8. | Detergent, ELS | No. | Chemicat P-145 | 9.6 | −7 |
| 9. | None | No | Versa-TL 4 (Not rinsed out; then Chemicat P-145) | 11.2 | 9 |

The additives listed in the foregoing table are identified as follows:

AOS-C1416 (The Chemithon Corporation) is the sodium salt of alpha olefin sulfonate made from a 1:1 blend of 14 carbon atom and 16 carbon atom olefins.

AOS-C10, AOS-C18, and AOS-C20 (The Chemithon Corporation) are sodium salts of alpha olefin sulfonates from 10 carbon atom, 18 carbon atom, and 20 carbon atom olefins, respectively.

ELS (The Chemithon Corporation) is the ammonium salt of ethoxylated lauryl sulfate.

Neodol 25-9 (Shell Chemical Company) is an ethoxylated alcohol composition comprising a blend of alcohols of 12 to 15 carbon atoms ethoxylated to an average of 9 moles of ethylene oxide per mole of alcohol.

Versa-TL 4 (Proctor Chemical Company, Inc.) is an anionic polyelectrolyte comprising sodium polystyrene sulfonate having a molecular weight of about 4000.

Orzan A (Crown Zellerbach Corp.) is essentially ammonium lignosulfonate with a minor amount of wood sugars.

Lomar LS (Diamond Shamrock Corporation) is the sodium salt of naphthalene sulfonate-formaldehyde condensate.

Chemicat P-145 (Chemirad Corporation) is a polyethylene imine having a molecular weight of about 55,000.

Kymene 557H (Hercules Incorporated) is a cationic polyamide-polyamine resin.

Pearl corn starch (Corn Products Corporation) is plain, unmodified corn starch.

A comparison of Examples 2a and 2c with Examples 2b and 2d, respectively, shows that anionic additives of the relatively low molecular weight detergent category should be rinsed out of the pulp in order to achieve an improvement in bursting strength of the paper. Examples 2e, 2f, and 2g show significant bursting strength improvement using other organic sulfonates of the detergent category which are rinsed out of the pulp prior to formation of paper.

In Example 3, no improvement in bursting strength was obtained using a non-ionic additive even though it was rinsed out of the pulp.

Example 4 using several different anionic organic polyelectrolytes gave greater improvements in bursting strength than were obtained with the anionic detergent additives used in Example 2, and it was unnecessary to rinse the pulp.

In Example 5, the wet end addition of a cationic polyelectrolyte to the pulp made using an anionic polelectrolyte resulted in a greater improvement in bursting strength than obtained by the anionic additives alone as used in Example 4. In Example 6, even further improvements in bursting strength were obtained by using both starch and the cationic polyelectrolyte as the wet end additives.

Comparison of Example 8 with Example 5a shows that a non-polymeric detergent that is not washed out of the pulp after its use in the cooking stage performs poorly despite subsequent wet end addition of a cationic polyelectrolyte, whereas an anionic polyelectrolyte that is not rinsed out of the pulp and then similarly treated at the wet end with a cationic polyelectrolyte performs well.

Examples 7 and 9 show that neither a detergent nor an anionic polyelectrolyte performs well when used as a simple wet end additive.

Although not shown in the table of data, tearing strength measurements were also made on the paper of Examples 4, 5, and 6. The improvement in Tear Factor ranged from 4% to 41% and averaged about 34%.

In the above-described tests it was necessary to use a low pulp consistency of 2.3% for practical handling of the pulp under experimental conditions. Consequently, the amount of anionic additive used was 4.35% based on the fiber weight. However, that high level of addition was needed only because of the laboratory scale of the tests. Much lower amounts of additive would be suitable at the higher consistency levels used in large scale commercial equipment. The amounts of additive required at higher consistency levels can be calculated by means of Riddick's equation (see "Control Of Colloid Stability Through Zeta Potential", Thomas Riddick, Chapter 10):

$$Q=ax+by$$

where

Q=mg additive/kg slurry
a=g water/kg slurry
b=g fiber/kg slurry
x=mg additive/g water
y=mg additive/g fiber The use of Riddick's equation requires a knowledge of the distribution of the anionic additive as the amount adsorbed onto the fiber and the amount remaining in solution. This information is obtained from measurements of the specific conductance of the aqueous portion of a fiber slurry while the additive is titrated incrementally, compared to similar measurements on a solution of the additive in water alone, i.e. without the presence of fiber. Curves obtained from a plot of these data show that, at the same concentration of additive, the aqueous portion of the slurry has a lower specific conductance than the solution of the additive in water alone because in the fiber slurry some of the additive has been adsorbed onto the fiber and does not participate in the conductance. Thus, a method is provided of measuring the distribution of the anionic additive between the amount adsorbed on the fibers and the amount remaining in solution. By use of such data in Riddick's equation the amounts of anionic additive required at consistencies of 30%, 40%, and 50% are calculated to be 0.64 wt.%, 0.57 wt.%, and 0.52 wt.% of the wood (o.d. basis), respectively.

I claim:

1. A method of improving the bursting strength of paper made from mechanical or thermomechanical pulp which comprises incorporating into mechanical or thermomechanical pulp at an elevated temperature and pressure an anionic organic surface active agent in an amount sufficient to improve the bursting strength of the paper subsequently formed from the pulp.

2. The method of claim 1 wherein the mechanical or thermomechanical pulp is formed by defibering wet wood by mechanical attrition at an elevated temperature and pressure, and said anionic organic surface active agent is added to the wood prior to or during said defibering step.

3. The method of claim 2 wherein said wood is heated at an elevated temperature and pressure in a preheating step prior to said defibering step, the preheated wood is introduced into a mechanical refiner wherein said wood is defibered at an elevated temperature and pressure, and said anionic organic surface active agent is added to either or both of said preheating and defibering steps.

4. The method of claim 1 wherein the mechanical or thermomechanical pulp is formed by defibering wet wood by mechanical attrition, and the resultant pulp is cooked in a post-refining step at an elevated temperature and pressure together with said anionic organic surface active agent.

5. The method of claim 1 wherein the pulp is formed by defibering wet wood by mechanical attrition without the addition of external heat, the resultant pulp is cooked in a post-refining step at an elevated temperature and pressure, and said anionic organic surface active agent is added either to the wood in said defibering step or to the pulp in said post-refining step.

6. The method of claim 1 wherein said temperature is from about 100° to about 145° C. and said pressure is from about 5 to about 45 psig.

7. The method of claim 1 wherein the amount of said anionic organic surface active agent is from about 0.4 to about 0.7 wt.% of said wood (o.d. basis).

8. The method of claim 1 wherein said anionic organic surface active agent comprises an anionic organic polyelectrolyte or polymer.

9. The method of claim 8 wherein said anionic organic polyelectrolyte or polymer comprises a polymeric sulfonate.

10. The method of claim 9 wherein said polymeric sulfonate is selected from the group consisting of polystyrene sulfonates, lignosulfonates, and naphthalene sulfonate condensates.

11. The method of claim 8 wherein said anionic organic polyelectrolyte or polymer comprises a polymeric carboxylate.

12. The method of claim 11 wherein said polymeric carboxylate is selected from the group consisting of the salts of acrylic acid polymers and copolymers and maleic acid polymers and copolymers.

13. The method of claim 8 further characterized in that said pulp is not rinsed to remove said anionic organic polyelectrolyte or polymer prior to formation of paper from said pulp.

14. The method of claim 1 wherein said anionic organic surface active agent comprises an anionic organic detergent.

15. The method of claim 14 wherein said anionic organic detergent is selected from the group consisting of organic sulfonates, sulfates, ethoxylated sulfates, phosphates, and ethoxylated phosphates.

16. The method of claim 14 wherein said pulp is rinsed to remove said anionic organic detergent prior to formation of paper from said pulp.

17. The method of claim 1 further characterized in that when said anionic organic surface active agent comprises an anionic organic detergent, said pulp is rinsed to remove said anionic detergent prior to formation of paper from said pulp.

18. The method of claim 1 wherein said anionic organic surface active agent is selected from the group consisting of anionic organic polyelectrolytes or polymers and anionic organic detergents, said pulp being rinsed to remove the anionic organic surface active agent prior to formation of paper from the pulp when an anionic organic detergent is used but not rinsed when an anionic organic polyelectrolyte or polymer is used.

19. A method of producing paper having improved bursting strength from mechanical or thermomechanical pulp which comprises defibering wet wood by mechanical attrition to form mechanical or thermomechanical pulp, processing said pulp to form a furnish, introducing said furnish into a papermaking machine and therein forming a sheet and heat drying the sheet to form paper, incorporating into the pulp at an elevated temperature and pressure an anionic organic polyelectrolyte or polymer in an amount sufficient to improve the bursting strength of the paper, and adding to said furnish a cationic organic polyelectrolyte or polymer which reacts with said anionic organic polyelectrolyte or polymer, whereby to further improve the bursting strength of said paper.

20. The method of claim 19 wherein starch is also added to said furnish along with said cationic organic polyelectrolyte or polymer as a premixture.

21. The method of claim 20 wherein said cationic organic polyelectrolyte or polymer and said starch are added to said furnish as an aqueous suspension or dispersion and the temperature is maintained below the gelatinization temperature of said starch until said heat drying of said sheet.

22. The method of claims 19, 20, or 21 wherein said cationic organic polyelectrolyte or polymer is selected from the group consisting of polyamide-polyamine resins, polyethylene imines, urea-formaldehyde resins, melamine-formaldehyde resins, and polyacrylamides.

23. The method of claim 19 wherein said wood is heated at an elevated temperature and pressure in a preheating step prior to said defibering step, the preheated wood is introduced into a mechanical refiner wherein said wood is defibered at an elevated temperature and pressure, and said anionic organic polyelectrolyte or polymer is added to either or both of said preheating and defibering steps.

24. The method of claim 23 wherein said anionic organic polyelectrolyte or polymer is a polymeric sulfonate selected from the group consisting of polystyrene sulfonates, lignosulfonates, and naphthalene sulfonate condensates, and said cationic organic polyelectrolyte or polymer is selected from the group consisting of polyamide-polyamine resins, polyethylene imines, urea-formaldehyde resins, melamine-formaldehyde resins, and polyacrylamides.

* * * * *